US006915731B2

(12) United States Patent
Mischker et al.

(10) Patent No.: US 6,915,731 B2
(45) Date of Patent: Jul. 12, 2005

(54) CYLINDER PISTON DRIVE

(75) Inventors: Karsten Mischker, Leonberg (DE); Uwe Hammer, Hemmingen (DE); Stefan Reimer, Markgroeningen (DE); Ralph Engelberg, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 35 days.

(21) Appl. No.: 10/477,227

(22) PCT Filed: Jan. 17, 2003

(86) PCT No.: PCT/DE03/00120

§ 371 (c)(1),
(2), (4) Date: Nov. 6, 2003

(87) PCT Pub. No.: WO03/074844

PCT Pub. Date: Sep. 12, 2003

(65) Prior Publication Data

US 2004/0154564 A1 Aug. 12, 2004

(30) Foreign Application Priority Data

Mar. 7, 2002 (DE) ..... 102 10 158

(51) Int. Cl.[7] ..... F01L 9/02
(52) U.S. Cl. ..... 92/6 R; 92/62
(58) Field of Search ..... 92/6 R, 52, 62, 92/255; 123/90.12

(56) References Cited

U.S. PATENT DOCUMENTS 3,209,737 A * 10/1965 Omotehara et al. ..... 92/62
3,844,528 A 10/1974 Massie
4,974,495 A 12/1990 Richeson, Jr.
5,682,846 A * 11/1997 Scharnweber ..... 123/90.12
6,321,703 B1 11/2001 Diehl et al.

FOREIGN PATENT DOCUMENTS

| | | |
|---|---|---|
| DE | 198 26 047 | 12/1999 |
| DE | 100 40 115 | 2/2002 |
| DE | 101 43 959 | 3/2003 |
| EP | 0 443 218 | 8/1991 |

* cited by examiner

*Primary Examiner*—Thomas E. Lazo
(74) *Attorney, Agent, or Firm*—Kenyon & Kenyon

(57) ABSTRACT

A cylinder-piston drive, e.g., an hydraulically controlled actuator for actuating a gas-exchange valve of an internal combustion engine, has an operating piston that is displaceable inside a cylinder and delimits pressure chambers by piston sides facing away from one another. The operating piston has a multipart design and is made up of at least two partial pistons that are placed inside one another, are displaceable relative to each other and strike against one another at stop faces. One pressure chamber is delimited by all, and the other pressure chamber is delimited by only a part, of the partial pistons and the sliding paths of the partial pistons not delimiting the other pressure chamber may be reduced compared to the overall sliding path of the operating piston. At least one stop face, arranged on the cylinder, may be provided against which a stop face of one of the partial pistons strikes after traveling the reduced sliding path. At least some of the stop faces associated with each other may be designed as conical surfaces that in each case form a conical seat when struck. In this manner, the leakage volume flow may be reduced by the operating piston.

11 Claims, 1 Drawing Sheet

CYLINDER PISTON DRIVE

FIELD OF THE INVENTION

The present invention relates to a cylinder-piston drive.

BACKGROUND INFORMATION

The present invention relates to a cylinder-piston drive, in particular an hydraulically controlled actuator for actuating a gas-exchange valve of an internal combustion engine, having an operating piston, which is displaceable inside a cylinder and which delimits pressure chambers by piston sides facing away from one another. The operating piston may be made up of a plurality of parts and consists of at least two partial pistons, which are placed inside one another, are displaceable relative to one another and are able to strike one another at stop faces. One pressure chamber may be delimited by all partial pistons and the other pressure chamber may be delimited by only a part of the partial pistons. The sliding paths of the partial pistons not delimiting the other pressure chamber are reduced with respect to the overall sliding path of the operating piston, and at least one stop face, arranged on a cylinder, may be provided, which a stop face of one of the partial pistons strikes after traveling the reduced sliding path.

Such a cylinder-piston drive is described in German Published Patent Application No. 101 43 959 and relates to an hydraulically controlled actuator for actuating a gas-exchange valve. The actuator allows the effective areas of the operating piston, which open and/or close the gas-exchange valve, to be modified as a function of its sliding path, so that the actuating force acting on the gas-exchange valve may meet special demands, such as an initially high opening force of the actuator, so that the gas-exchange valve is able to open against the residual gas pressure, or a reduced closing force shortly before the valve closes, for noise and wear reasons.

SUMMARY

According to an exemplary embodiment of the present invention, the stop faces may be designed as conical surfaces forming a conical seat in each case, which may have the result that the pressure chambers, which may be separated from one another by the partial pistons guided inside each other, may be sealed much more effectively. Therefore, the leakage volume flow that cannot always be entirely avoided in the case of multipart operating pistons may be substantially reduced or completely eliminated. With respect to its leakage behavior, the multipart operating piston configured according to an exemplary embodiment of the present invention may then no longer have disadvantages compared to a one-piece operating piston. Given the same leakage volume flow as in a multipart operating piston that is not designed according to an exemplary embodiment of the present invention, it may be possible, as an alternative, to allow larger manufacturing tolerances, in this manner achieving lower manufacturing costs of the cylinder-piston drive. Since, in the case of conical seats, the associated conical surfaces may be pressed together more and more as the pressure difference increases in the two pressure chambers, the sealing effect may be self-enhancing.

The cone angles of the associated conical surfaces may have a slight angular difference and may contact each other substantially in the form of a line contact. Such a conical seat, in which a line contact results because of a differential angle, may provide an especially high tightness, since the line contact may have the effect of a sealing edge being pressed, under prestress, against a sealing surface.

An exemplary embodiment of the present invention is illustrated in the drawings and explained in greater detail in the following description.

DETAILED DESCRIPTION

Figure 1:
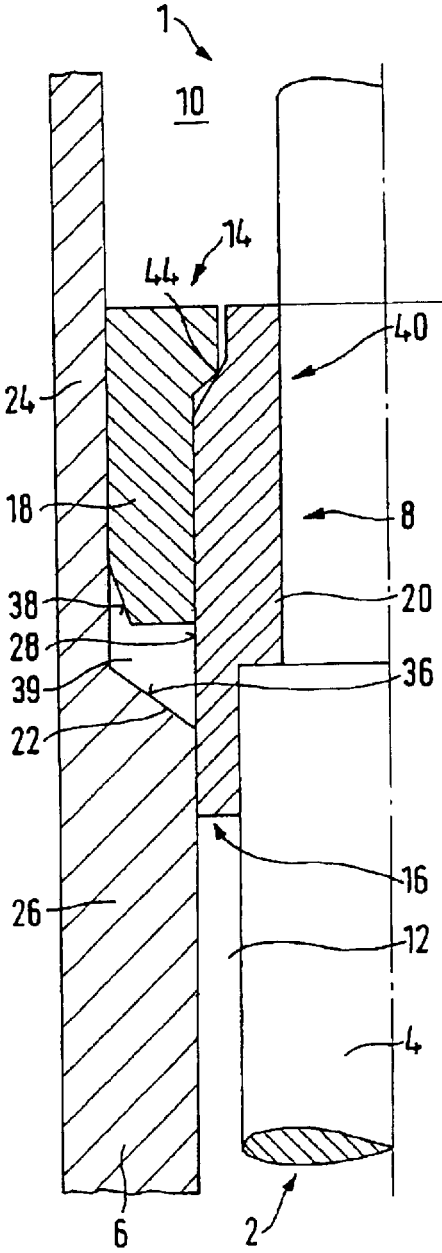
FIG. 1 shows a partial cross section through an exemplary embodiment of a cylinder-piston drive according to the present invention in the form of an actuator for actuating a gas-exchange valve, in a valve-closed position.

According to an exemplary embodiment of the cylinder-piston drive according to the present invention, FIG. 1 shows a schematic part-sectional view of an hydraulically controlled actuator 1 for actuating a gas-exchange valve 2 of an internal combustion engine. The actuator is shown in a position of normal use, i.e., the components shown at the bottom are also installed at the bottom. Gas-exchange valve 2 may be used as an intake valve for controlling an intake-cross section, and as a discharge valve for controlling a discharge-cross section. Gas-exchange valve 2 may have a valve tappet 4 at whose lower end a valve disk is arranged, which may cooperate with a valve-seat surface formed in a cylinder head of the internal combustion engine in order to lift it off, to a greater or lesser degree, from the valve-seat surface and to release a certain flow cross section via a linear actuation of valve tappet 4.

Hydraulically controlled actuator 1 may have an operating piston 8, which may be held in cylinder 6 so as to be axially displaceable and which may act on valve tappet 4. By end faces facing away from one another, operating piston 8 may divide cylinder 6 into two hydraulic pressure chambers, namely into an upper pressure chamber 10 and a lower pressure chamber 12. The two pressure chambers 10, 12 may be filled with hydraulic oil and may be connected to a pressure-supply device via pressure lines. The end faces of operating piston 8 may constitute effective areas for the hydraulic pressure present in pressure chambers 10, 12. Pressure chamber 12 may be always pressurized and pressure chamber 10 may be acted on by the same pressure in order to open gas-exchange valve 2 via the larger end face of operating piston 8 facing this pressure chamber 10, or to close it by reducing the pressure in pressure chamber 10. The fundamental functioning method of such an hydraulically controlled actuator 1 is described in German Published Patent Application No. 198 26 047, for example.

Operating piston 8 may be designed such that there is a change in the surface area of the two effective areas along the sliding path of operating piston 8, so as to satisfy particular demands made on actuator 1 during opening and closing of gas-exchange valve 2. Such demands may be, for example, a high opening force at the beginning of the opening stroke of gas-exchange valve 2 in order to enable gas-exchange valve 2 to open against the residual gas pressure, and, on the other side, a marked reduction in the actuating force generated by actuator 1 following this fraction of the overall lift, so that the energy consumption required for controlling gas-exchange valve 2 may be reduced.

In the case at hand, these demands may be met in that operating piston 8 may be designed in such a manner that, in response to a displacement out of its valve-closed position shown in FIG. 1, upper effective opening area 14 may be larger in the leading area $s_1$ of the displacement path than it is in the remaining sliding path $s_2$. To this end, upper effective opening area 14 may get smaller by a predefined amount following the specified sliding path $s_1$ and remains constant until completion of the lift. In contrast, lower effective closing area 16 of operating piston 8 may remain generally constant across the entire closing lift $s_1+s_2$. Thus, gas-exchange valve 2 may be opened with great displacement force, which then drops rapidly and remains constant over the remaining lift $s_2$.

Figure 2:
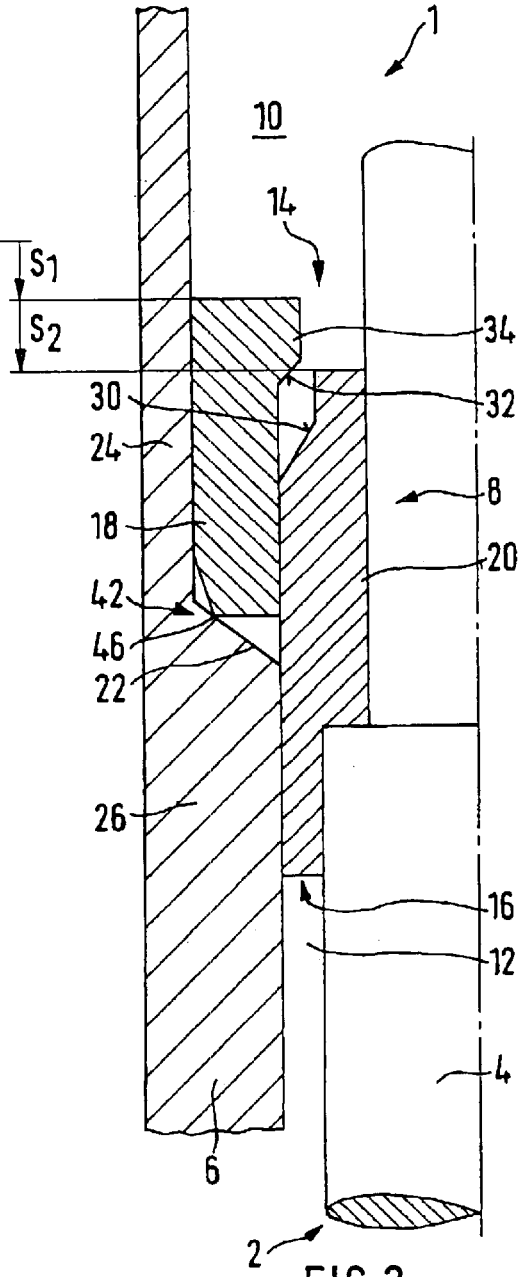
FIG. 2 shows the actuator from FIG. 1 in a valve-open position.

To this end, operating piston 8 may have a multipart design and may be made up of a plurality of partial pistons, e.g., two partial pistons inserted inside one another and displaceable relative to each other, e.g., an outer cylindrical piston 18 and an inner stepped piston 20. Stepped piston 20 may be either integrally formed with valve tappet 4 or, as shown in FIG. 1 and FIG. 2, may be configured as an annular body, which may have a stepped bore and may be pressed onto stepped valve tappet 4. Cylinder 6 may also have a bored step 22, an upper cylinder section 24, which may have a larger diameter, accommodating both partial pistons 18, 20, and a lower cylinder section 26, having a smaller diameter, guiding only stepped piston 20. Furthermore, cylindrical piston 18 may have a smaller axial length than stepped piston 20 whose end faces face both upper pressure chamber 10 and lower pressure chamber 12, whereas only one end face of cylindrical piston 18, e.g., the upper end face, may cooperate with a pressure chamber 10.

At its radially outer peripheral area, shorter cylindrical piston 18 may be guided by upper cylinder section 24 and at its radially inner peripheral area by a cylindrical guide section 28 formed on a stepped piston 20, while stepped piston 20 may be guided by lower cylinder section 26 of cylinder 6. The upper end, facing upper pressure chamber 10 and adjoining guide section 28, of stepped piston 20 may have a reduced diameter so as to provide a radially outer stop face 30 for an associated radially inner stop face 32 of cylindrical piston 18, which may be formed at an annular projection 34, as shown in FIG. 2.

By a radially inner stop face 36 formed at bore step 22 of cylinder 6, the sliding path of cylindrical piston 18 may be limited in that it may be provided with an associated radially outer stop face 38 at its end facing lower pressure chamber 12 (FIG. 1). In contrast, the sliding path of longer stepped piston 20 may be able to traverse the overall lift $s_1+s_2$ of operating piston 8. Furthermore, bore step 22 of cylinder 6 completely may decouple cylindrical piston 18 from lower pressure chamber 12. Space 39 between bore step 22 of cylinder 6 and cylindrical piston 18 may be relieved to the point of ambient pressure.

When operating piston 8 is displaced out of its valve-open position shown in FIG. 1, in the valve-opening direction, this being effected by fluid pressure being input into upper pressure chamber 10, both partial pistons 18, 20 may be first acted on by pressure and both may be displaced downward. The opening upper effective area 14 of operating piston 8 may then be made up of the two annular end faces of both partial pistons 18, 20 and may be maximal. Once operating piston 8 has completed valve travel $s_1$, radially outer stop face 38 of cylindrical piston 18 strikes against associated stop face 36 of cylinder 6, so that cylindrical piston 18 no longer participates in the further displacement of operating piston 8. The effective opening area 14 is thus reduced to the end face of inner stepped piston 20 acted on by the fluid pressure, so that the displacement force of actuator 1 is reduced and the energy consumption drops during the further opening of gas-exchange valve 2.

If, upon reaching the open position of gas-exchange valve 2, the closing procedure is initiated by relieving upper pressure chamber 10, inner stepped piston 20 having traveled sliding path $s_2$, outer cylindrical piston 18 may be carried along across sliding path $s_1$ by inner stepped piston 20, up to the closed position of operating piston 8, in that the two associated stop faces 30, 32 at stepped piston 20 and at cylindrical piston 18 may come to rest against each other, as shown in FIG. 1.

As can be gathered from FIG. 1 and FIG. 2, respective associated stop faces 30, 32 and 36, 38 may be designed as conical surfaces that, when striking against one another, form a conical seat 40, 42, the conical surfaces being pressed together or disengaging depending on the direction of the actuating force being exerted in each case. Specifically, according to FIG. 1 (valve-closed position), radially inner conical surface 32 of cylindrical piston 18 and radially outer conical surface 30 of stepped piston 20 may form a conical seat 40 when striking against one another and, according to FIG. 2 (valve-open position), radially outer conical surface 38 of cylindrical piston 18 and radially inner conical surface 36 of cylinder 6 may form an additional conical seat 42.

Associated conical surfaces 30, 32 and 36, 38 may have slightly different cone angles, so that they contact each other substantially in the form of a line contact, which, in the present case, has the form of a peripheral circular ring 44, 46. The cone angle difference between the associated conical surfaces 30, 32 and 36, 38 is shown in a highly exaggerated illustration in FIG. 1 and FIG. 2 for better visualization.

In a further development of described operating piston 8, it may also be constructed from more than only two partial pistons 18, 20. The individual partial pistons may then have different lengths again and lose their effectiveness in the further movement of the operating piston by an appropriate definition of their valve travel, so that the effective opening area of the operating piston may change several times in the course of its overall valve travel. It may be understood that the stop faces provided at the plurality of partial pistons may be designed as conical surfaces and complement the associated conical surface of the other partial piston or the cylinder to form a conical seat together.

What is claimed is:

1. A cylinder-piston drive, comprising:

an operating piston adapted to be displaced inside a cylinder and to delimit pressure chambers by piston sides facing away from one another, the operating piston including a multipart design and including at least two partial pistons inserted inside one another, the partial pistons displaceable relative to each other and adapted to strike against one another at stop faces, one pressure chamber delimited by all of the partial pistons and another pressure chamber delimited by less than all of the partial pistons, at least one reduced sliding path of the partial pistons not delimiting the other pressure chamber less than an overall sliding path of the operating piston; and at least one stop face arranged on the cylinder adapted to strike against a further stop face of one of the partial pistons after the one of the partial pistons travels one reduced sliding path;

wherein at least some of the stop faces associated with each other include conical surfaces that form a conical seat when striking against one another.

2. The cylinder-piston drive of claim 1, wherein cone angles of the conical surfaces associated with one another have a slight angle difference and contact one another substantially in a form of a line contact.

3. The cylinder-piston drive of claim 2, wherein the partial pistons have different axial lengths.

4. The cylinder-piston drive of claim 3, wherein the operating piston includes two partial pistons, an outer cylindrical piston having the reduced sliding path having a smaller axial length than an inner stepped piston arranged to travel an entire sliding path.

5. The cylinder-piston drive of claim 4, wherein the stepped piston is one of joined to a piston rod and integrally formed with the piston rod.

6. The cylinder-piston drive of claim 4, wherein:

the cylinder has a bored step;

a cylinder section having a larger diameter and accommodating the two partial pistons; and another cylinder section having a smaller diameter and guiding only the stepped piston.

7. The cylinder-piston drive of claim 6, wherein an end of the stepped piston facing the one pressure chamber has a radially outer conical surface adapted to cooperate with an associated radially inner conical surface of the cylindrical piston formed at an annular projection.

8. The cylinder-piston drive of claim 6, wherein the reduced sliding path of the outer cylindrical piston is configured to be limited by a radially inner conical surface formed at the bored step of the cylinder, the outer cylindrical piston including an associated radially outer conical surface at an end facing the other pressure chamber.

9. The cylinder-piston drive of claim 8, wherein the radially outer conical surface of the outer cylindrical piston and the inner conical surface of the cylinder are adapted to form a conical seat when struck.

10. The cylinder-piston drive of claim 7, wherein the radially inner conical surface of the outer cylindrical piston and the outer conical surface of the stepped piston are adapted to form a conical seat when struck.

11. The cylinder-piston drive of claim 1, wherein the cylinder-piston drive includes an hydraulically controlled actuator adapted to actuate a gas-exchange valve of an internal combustion engine.

* * * * *